US010024097B1

(12) United States Patent
Glickman et al.

(10) Patent No.: US 10,024,097 B1
(45) **Date of Patent: *Jul. 17, 2018**

(54) ONE-PIECE SILL PAN FLASHING

(71) Applicants: Joel I. Glickman, Jupiter, FL (US); Kieran McMahon, Ambler, PA (US)

(72) Inventors: Joel I. Glickman, Jupiter, FL (US); Kieran McMahon, Ambler, PA (US)

(73) Assignee: Sill Dry Industries, LLC, Hatfield, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/707,321

(22) Filed: Sep. 18, 2017

Related U.S. Application Data

(63) Continuation-in-part of application No. 15/496,654, filed on Apr. 25, 2017.

(51) Int. Cl.

| | |
|---|---|
| ***E06B 1/62*** | (2006.01) |
| ***E06B 1/70*** | (2006.01) |
| ***E06B 7/14*** | (2006.01) |
| ***E06B 7/22*** | (2006.01) |
| ***E06B 3/96*** | (2006.01) |
| ***E06B 3/30*** | (2006.01) |

(52) U.S. Cl.
CPC ..... *E06B 1/62* (2013.01); *E06B 1/702* (2013.01); *E06B 3/308* (2013.01); *E06B 3/9632* (2013.01); *E06B 7/14* (2013.01); *E06B 7/22* (2013.01); *E06B 2001/628* (2013.01)

(58) Field of Classification Search
CPC . E06B 3/9632; E06B 7/22; E06B 7/14; E06B 1/702; E06B 1/705; E06B 3/308; E06B 2001/628; E06B 1/62; E06B 1/70; E06B 7/26; E04B 1/665
See application file for complete search history.

(56) References Cited

U.S. PATENT DOCUMENTS

| | | | |
|---|---|---|---|
| 1,677,130 | A | 7/1928 | Cherry |
| 5,072,552 | A | 12/1991 | Sauder |
| 5,581,959 | A | 12/1996 | Occhipinti |
| 6,122,874 | A | 9/2000 | Smerilli |
| 6,681,530 | B1 | 1/2004 | Givens |
| 7,222,462 | B2 | 5/2007 | Ellingson |
| 7,351,296 | B2 | 4/2008 | Waggoner et al. |
| 7,673,426 | B2 | 3/2010 | Broad et al. |
| 7,676,996 | B2 | 3/2010 | Teodorovich |

(Continued)

*Primary Examiner* — Adriana Figueroa
*Assistant Examiner* — Jessie T Fonseca
(74) *Attorney, Agent, or Firm* — St. Onge Steward Johnston & Reens, LLC

(57) ABSTRACT

A one-piece sill pan flashing is provided with one or more accordion sections. At least the accordion sections, and preferably the entire flashings, are formed of a single sheet of thermoplastic material, preferably by thermoforming, and include forwardly and downwardly inclined upper portions and vertical lower portions extending downward from the front of the upper portions. The accordion sections include upper and lower portions, formed of narrow panels, foldably connected along their lateral edges to form V-shaped accordion folds having a series of ridge folds and valley folds. The valley folds of the upper portions are aligned with the ridge folds of the lower portions and vice versa. The construction accommodates substantial extension or compression of the width of the flashing and enables one size of flashing width to be fitted to a wide range of sizes of rough-framed window openings.

17 Claims, 5 Drawing Sheets

(56) References Cited

U.S. PATENT DOCUMENTS

| | | | |
|---|---|---|---|
| 7,788,855 | B2 | 9/2010 | Mileti et al. |
| 7,877,945 | B2 | 2/2011 | Eggen et al. |
| 8,117,789 | B2 | 2/2012 | Teodorovich |
| 8,443,554 | B1 | 5/2013 | Teodorovich |
| 8,561,357 | B2 | 10/2013 | Teodorovich |
| 8,695,293 | B2 | 4/2014 | Teodorovich |
| 2005/0217189 | A1 | 10/2005 | Moffitt |
| 2008/0229676 | A1 | 9/2008 | Allen |
| 2009/0056241 | A1 | 3/2009 | Koessler et al. |
| 2009/0272045 | A1 | 11/2009 | Teodorovich |
| 2010/0058683 | A1 | 3/2010 | Bushberger |

ONE-PIECE SILL PAN FLASHING

FIELD OF THE INVENTION

The invention relates generally to the field of home and office construction and more particularly to a novel and improved, adjustable one-piece sill pan flashing for installation at the bottom of the rough framing of a window or door opening in order to prevent penetration of water underneath a window or door sill and into the underlying framing structure.

BACKGROUND OF THE INVENTION

In the home construction industry, it is typical for windows and doors to be constructed as independent, prefabricated units and installed in roughly framed openings constructed in the exterior walls of the home. The exterior framing of the window and door units overlap the exterior of the housing wall around the framed openings and initially are sealed to prevent access of moisture. Over time the sealing material may deteriorate and allow some moisture to penetrate. This can result in deterioration of the wood framing and of housing structure below the framed opening. Accordingly, in many such structures it is the practice to install a sill pan flashing between the bottom of the window or door unit and the underlying sill plate of the rough framing. The sill pan flashing is formed of a suitable plastic or metal material and serves to direct any collected water outward to the exterior of the siding. Examples of such sill pan flashing devices are shown in U.S. Pat. No. 1,677,130, No. 7,222,462, No. 7,673,426, and No. 8,443,554.

A typical framed window or door opening includes a horizontal sill plate and spaced apart vertical elements, joined to opposite ends of the sill plate and extending upward therefrom. The upper ends of the vertical elements are joined to a header member, which extends horizontally between upper ends of the vertical members and forms a closed opening, usually of rectangular configuration, in which a prefabricated window or door unit can be received. The elements comprising the framed opening typically may be formed of 2"×4" lumber. In addition, a rough siding typically is secured to the exterior framing of the structure, and an opening is cut into the rough siding in the size and shape to coincide with the framed opening. The rough siding may be of ½" or ¾" plywood, for example.

A sill pan flashing of typical construction includes a sill plate cover arranged to extend over the full width of the sill plate, which forms the bottom member of the framed opening. The sill plate cover is inclined downwardly toward the front to allow to allow water to drain forwardly toward the exterior of the structure. Typically, a front flange extends downward a short distance from the front of the sill cover to guide the flow downward over the exterior shingles, siding or other outer surface of the finished structure. The front flange typically extends laterally a few inches beyond the sides of the opening so as to cover a small front area of the rough siding. Portions of the front flange also extend upwardly a few inches above the level of the sill plate at each side of the opening. Side flanges also extend upward a few inches from each end of the sill cover and overlie lower portions of the vertical framing members. The side flanges are joined at their front vertical edges with the upwardly extending portions of the front flange to form rigid corners structure at opposite sides of the framed opening.

It is standard construction practice to dimension the rough-framed window or door openings to dimensions somewhat larger than the standard dimensions of the prefabricated windows to be inserted therein. Window and door manufacturers frequently recommend that the opening defined by the framing be a half to three-quarters inch wider than the nominal size of the window or door to be received. In actual practice it is common for the dimensions of the rough framing to vary significantly from the recommended tolerances, anywhere from a half to three-quarters inch smaller to more than an inch larger than recommended. This presents a problem with respect to the installation of the sill pan flashings, because the required width of the flashing, in order to fit snuggly between the vertical elements of the frame, may be different for each of many framed openings that are "nominally" of the same size. Heretofore, this commonly has been dealt with by forming the sill pan flashings in two or three (sometimes more) pieces, which are assembled in the field to fit the individual openings. A two-piece assembly, for example, is made to fit the largest opening expected to be encountered in the field for a given nominal size window unit. For a prefabricated window unit of 24" nominal width for example, the specified framing opening may be 24.5"-24.75". However, the actual opening made by the carpenters at the job site might range from as large as 25.5" or greater to as small as 24.0". Thus, a conventional two-piece sill pan flashing, intended for a window unit of nominal 24" width, is dimensioned so that the pieces have a total width substantially greater than the anticipated maximum opening of 25.5", enabling the two pieces to be assembled in the field in partially overlapping relation to fit a range of opening sizes. Typically, a sealant is applied in the field where the two pieces overlap, to avoid leakage at the interface between the parts.

The above described procedures, while enabling the flashing to be fit suitably to the framed opening, have important disadvantages. Among others, the individual installation of the two (or more) components, and the sealing of the interface(s) between them consumes extra labor time and thus adds to the cost of construction. Additionally, construction sites are often somewhat chaotic, and it is not uncommon for the individual components of a multi-part flashing assembly to become separated at the job site, so that all of the mating parts may not be readily available when the worker is ready to install them. Moreover, the caulking material, which is required to seal the interface between the parts, frequently is hastily and/or carelessly applied at the job site. If the sealant is not applied in a proper unbroken bead between the parts, the interface can become a source of water intrusion and damage.

It has been proposed heretofore to fabricate a sill pan flashing in one piece, sized suitably at a width greater than the maximum expected width of the rough opening. While this enables the flashing to be shipped to the job site in one piece, it must be cut into two parts at the job site in order to fit the opening. The then two-piece assembly is overlapped and sealed during installation in the same manner as the above-described multi-piece assemblies, with the addition of the cutting operation and the requirement of the necessary tools to perform the cutting operation. Such a proposal is found in the Broad et al. U.S. Pat. No. 7,673,426.

Our earlier invention, which is described in U.S. patent application Ser. No. 15/496,654, filed Apr. 25, 2017, represents a significant improvement in the design of sill pan flashing which enables the flashing is delivered to the user in one piece and also installed in one piece, without any cutting or sealing operations. In the design of our earlier invention, the flashing preferably is produced at the factory in a size sufficiently narrower than the nominal framing width that it will fit within a frame of the narrowest actual width, and it includes one or more accordion sections that allow the flashing to be extended in length during installation to fit any actual width within the expected range thereof. The thus improved flashing can be installed by first securing the flashing at one side of the framing, then enlarging the width as necessary by extending the accordion section(s), and then securing the flashing at the opposite side.

SUMMARY OF THE INVENTION

Our present invention is an even further improvement on our earlier invention in that the construction of the flashing enables it to be either expanded or compressed in width by very substantial amounts. An extremely important benefit of this characteristic is that the new sill pan flashings can be designed to a particular nominal flashing width, with the capability of being either enlarged or compressed substantially in length. The improved flashing thus can be installed in rough framing of a range of nominal framing widths both larger and smaller than the nominal width of the flashing itself. This characteristic enables manufacturers and sellers (typically large "home improvement" stores) to stock a much smaller inventory of flashing widths in relation to the more numerous nominal sizes of window and door framing in which the flashings are to be installed. This is an important advantage inasmuch as a one-piece flashing can be relatively large and bulky and occupy a significant amount of storage space. Since one flashing size according to our invention can be applied to a plurality of window sizes, the required inventory of sizes may be reduced to a fraction of what otherwise would be required.

The sill pan flashing of our invention makes novel use of accordion features sometimes found in the bellows of professional cameras but having special advantages and uniqueness in the particular environment of our new sill pan flashing. For use in a sill flashing, an accordion section must be constructed to have forwardly and downwardly inclined portions, to cover the sill plate, and vertical portions to lead collected water downward over the exterior of the structure. The accordion section comprises a series of narrow panels, foldably connected along lateral edges thereof forming, when partially folded, a series of ridges and valleys. At the juncture of the horizontal and vertical portions, the accordion folds are aligned such that the ridges of the inclined portions are aligned with the valleys of the vertical portions (and vice versa). This automatically forms the accordion section with a beveled front corner which is easily received in the small and code-limited space between rough framing and the prefabricated window unit. This construction also greatly reduces material stress at the front upper corners of the accordion sections and correspondingly minimizes the risk of weakening the material and compromising the weather integrity of the product.

In the device of our invention, at least the accordion section or sections are thermoformed from a single sheet of plastic, and preferably the entire flashing is a one-piece, thermoformed unit, preferably formed of a thermoplastic polyolefin material. The structure is cost effective and highly functional throughout the manufacturing and sales phases as well as during installation and protection phases.

For a more complete understanding of the above and other features and advantages of the invention, reference should be made to the following detailed description of the invention together with the accompanying drawings of a preferred embodiment thereof.

DETAILED DESCRIPTION OF THE INVENTION

Figure 1:
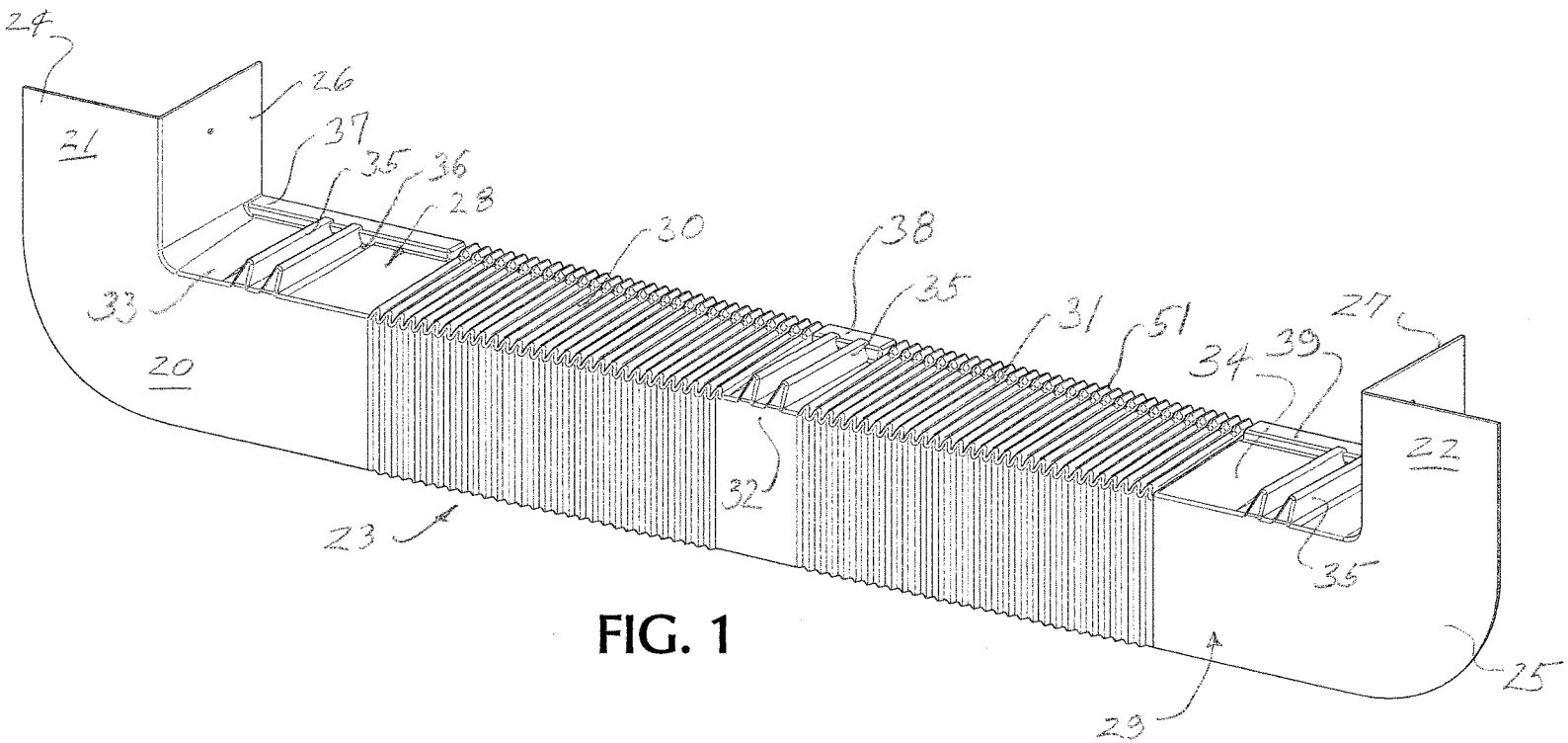
FIG. 1 is an orthographic view of a sill pan flashing according to the invention.
Figure 2:
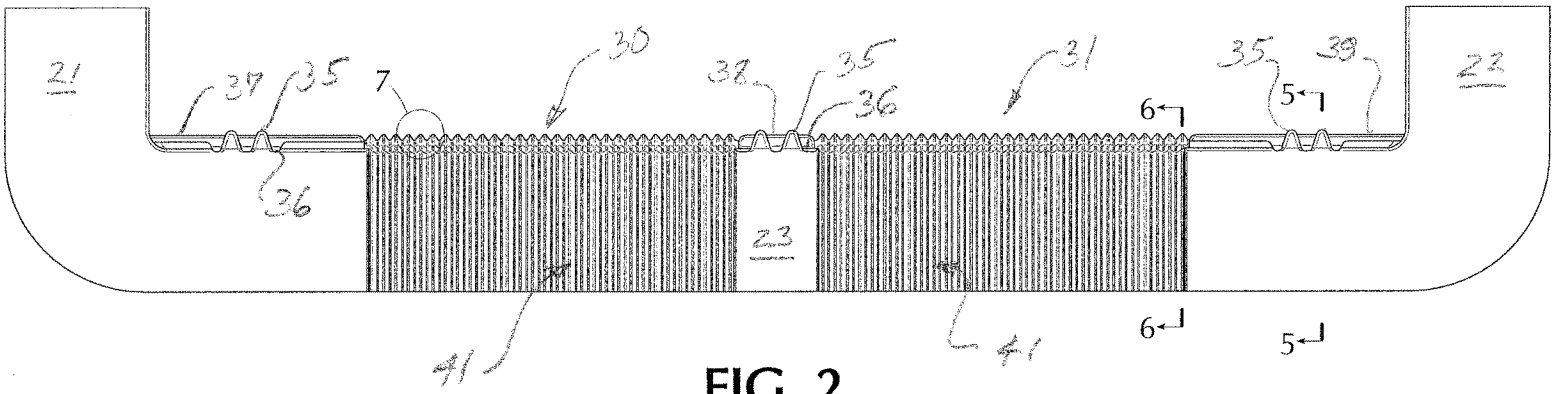
FIG. 2 is a front elevational view of the flashing of FIG. 1.
Figure 3:
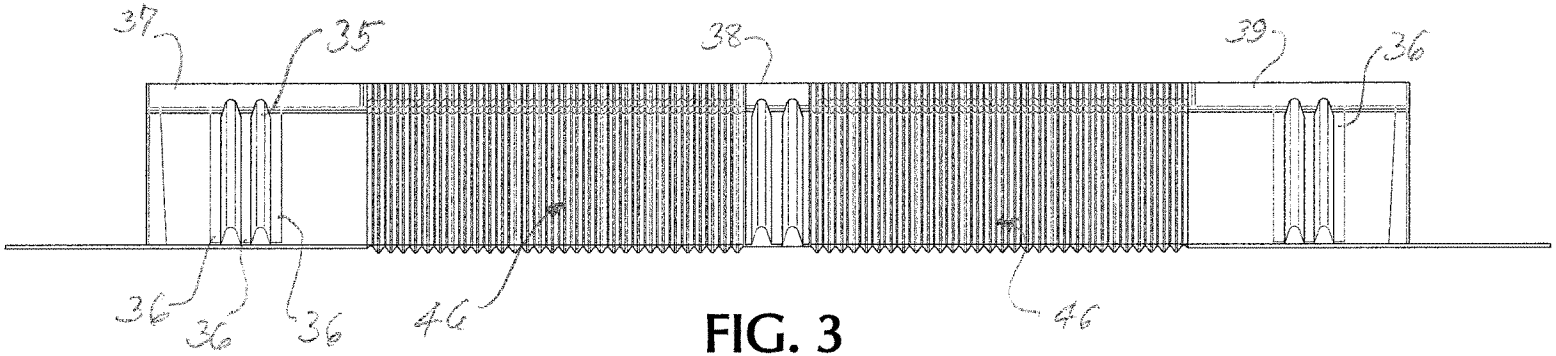
FIG. 3 is a top plan view of the flashing of FIG. 1.

Referring now to the drawings, the numeral 20 designates a sill pan flashing according to the invention, preferably formed of a single sheet of plastic material, preferably a thermoplastic polyolefin, preferably using a thermoforming process, but alternatively also as a single injection molded part of a similar material. For a thermoforming process, it is contemplated to utilize a sheet of plastic material of, for example, about 0.080 in in thickness. The flashing 20 is comprised of flanged end portions 21, 22 at opposite sides and a sill plate cover 23 extending between and joining the spaced apart end portions. The two end portions have front-facing vertical walls 24, 25 joined along vertical edges with laterally inwardly facing vertical walls 26, 27. These walls form rigid corners which are intended to engage and be secured to outer sheathing 17 and spaced-apart upright members 18 (FIG. 5) of a rough-framed opening of a suitable size and shape (typically rectangular) for the reception of a prefabricated window unit (not shown). The sill plate cover 23 includes a forwardly and downwardly inclined top structure 28 and a vertical front structure 29. When the unit is installed, the top structure 28 will rest upon and cover the sill plate 19 of the rough-framed opening while the vertical front portion 29 extends downward over the front of the sill plate.

In the illustrated embodiment of the invention, the sill plate cover 23 includes a pair of accordion sections 30, 31, to be described further. A central window-support section 32 is located between the accordion sections, and laterally spaced window-support sections 33, 34 are positioned between the accordion sections and the respective adjacent flanged end portions 21, 22. It will be understood, that a sill pan flashing according to the invention may incorporate more than two accordion sections or only one accordion section, depending upon the size of the rough framed opening and the window unit to be installed therein, and the number and positioning of window support sections may vary correspondingly. Normally, however, there should be window-support sections at each side of the flashing, for the smaller window sizes, with additional support sections provided for larger sizes.

Figure 4:
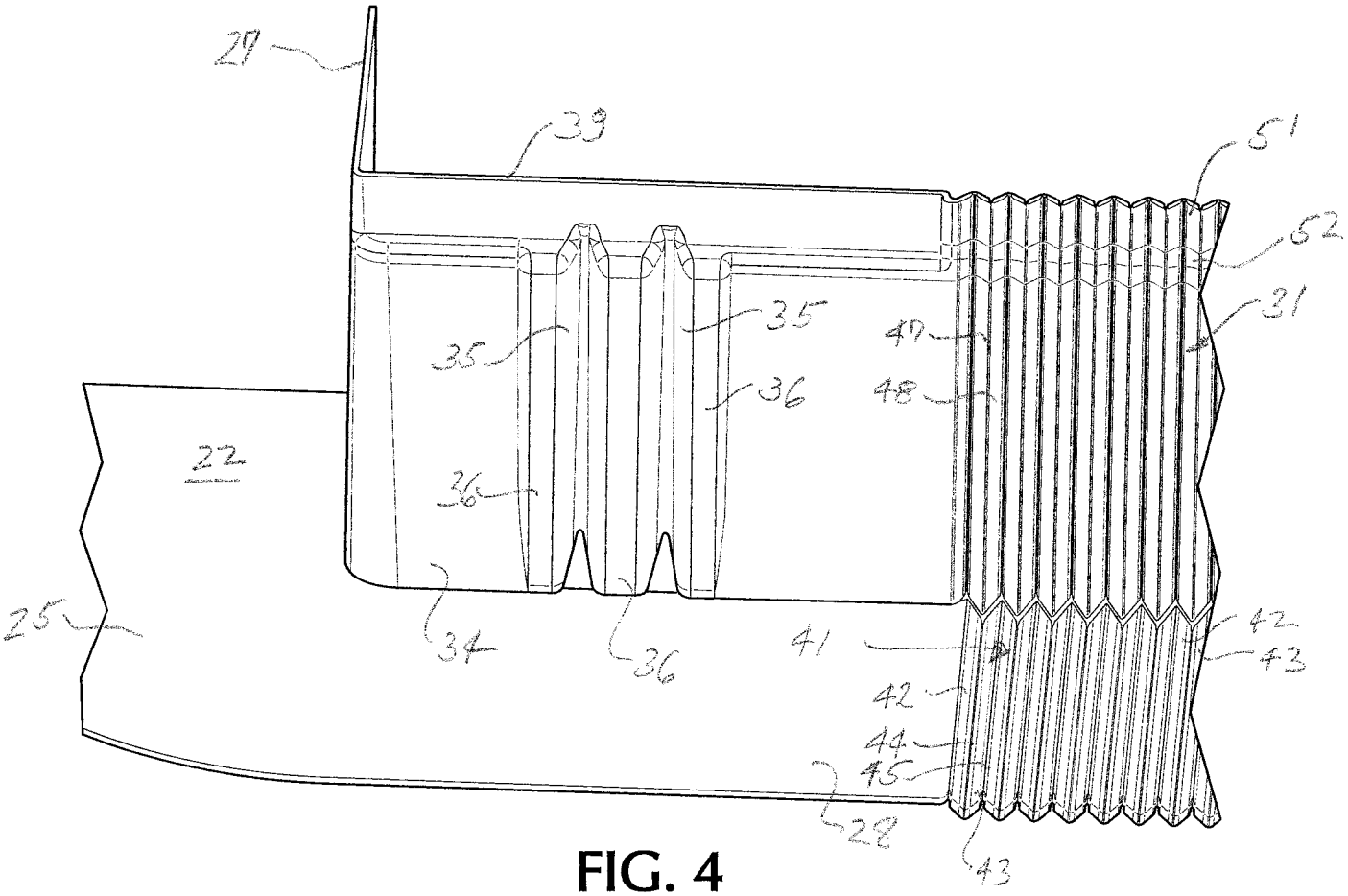
FIG. 4 is an orthographic view showing one end portion of the flashing of FIG. 1, from behind and underneath.
Figure 5:
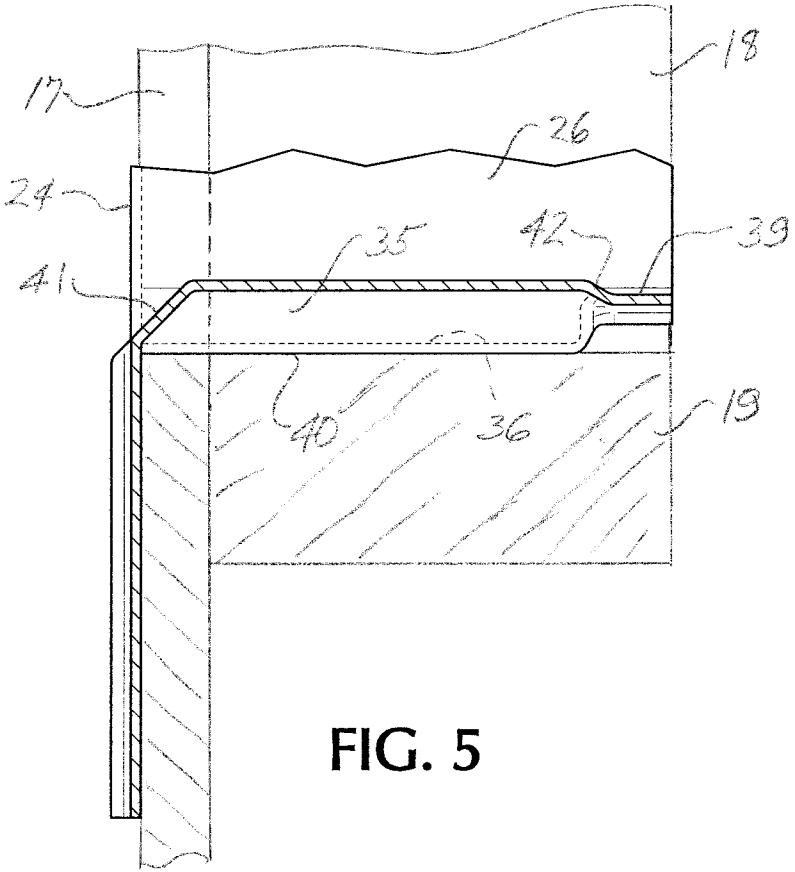

Substantially the entire upper surface areas of the sill plate cover 23, including the upper surfaces of the accordion sections 30, 31, are inclined downward and forward, preferably at an angle of about 2.5°, in order to direct any water to the front of the flashing and downward over the front surfaces thereof. In the window-support sections 32-34 there are also provided pairs of window support ribs 35, the tops of which extend horizontally front-to-back forming a horizontal support on which the sill of a prefabricated window unit may be supported. As indicated in the drawings, and particularly FIG. 6, the tops of the support ribs 35 lie at least a short distance (e.g., 0.17 in) above the tops of the accordion sections 30, 31, at their highest points at the rear of the flashing unit, such that the accordion sections, even if contracted significantly during installation, will not bear any of the weight of the window unit. Preferably, the support ribs 35 are of an inverted U-shaped cross section, open at the bottom, as shown in FIGS. 4 and 5, and closed at the front and back to maintain weather integrity. Desirably, the front and back faces 41, 42 of the ribs 35 are disposed at an inclined angle to better accommodate the thermoforming procedure.

Extending along the back edge of the flashing in the areas thereof not formed by the accordion sections 30, 31, are laterally extending elevated ridges 37-39. The elevated ridges 37-39 serve as stop elements for positioning of the prefabricated window units that are later installed in the rough framed openings. The elevated ridges, together with elevated back portions of the respective accordion sections 30, 31 (described hereinafter), also form an effective dam to prevent the upward and inward flow of water under the pressure of extreme winds. Extending along each lateral side of each of the support ribs 35 is a groove 36 which extends from the front edge of the flashing rearwardly to the ridges 37, 38, 39. The grooves 36 are horizontally disposed (unlike the remaining portions of the top structure 23 which are forwardly inclined). The bottom surfaces 40 of the grooves (see FIGS. 5 and 6) are arranged to be seated on the upper surface of the sill plate 19 of a rough framed opening in order to properly position and orient the flashing thereon at the desired elevation and forwardly tilted angle.

In accordance with one aspect of the invention the accordion sections 30, 31 preferably are integrally formed with the remainder of the flashing, as part of the thermoforming process. With reference particularly to FIGS. 1, 4, 7 and 8, the vertical front portions 41 of the accordion sections are comprised of a series of foldably connected narrow panels 42, 43 joined along outwardly and inwardly projected fold lines 44, 45 respectively. The outwardly projected fold lines 44 form "ridges" of the folded accordion structure while the inwardly projected fold lines 45 form "valleys" of the structure. In a representative but non-limiting example, the vertical front portions 41 of the accordion and the adjacent portions of the front structure 29 may extend downward about 4 inches.

Figure 8:
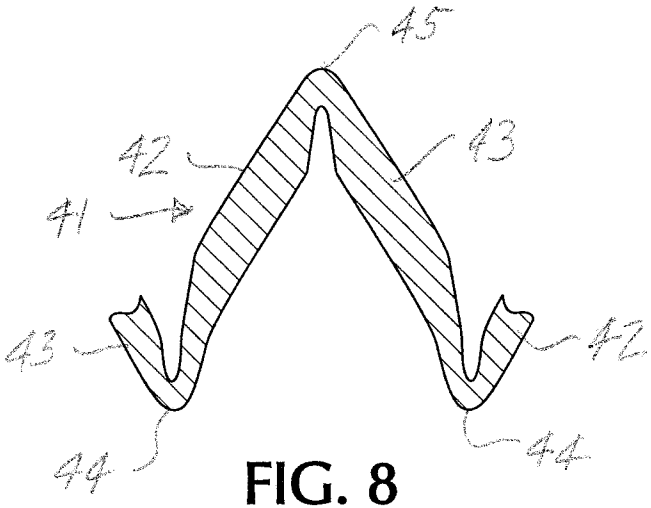
FIG. 8 is an enlarged, cross sectional view as taken generally on line 8-8 of FIG. 7.
Figure 7:
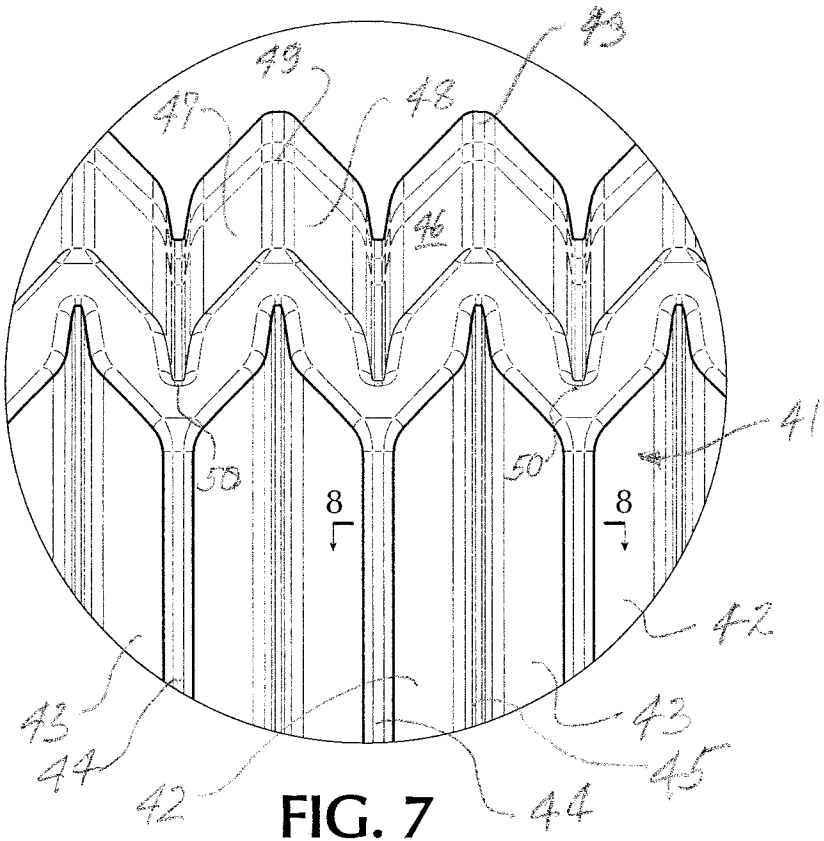
FIG. 7 is a greatly enlarged partial front elevational view of the flashing showing details of a small portion of an accordion section thereof.

As shown particularly in FIG. 8, the thermoforming process is carried out in such manner as to cause the fold lines 44, 45 to be of considerably less thickness than that of the adjacent panels 42, 43 connected thereby. In an exemplary but non-limiting embodiment of the invention, the fold lines may have a thickness of about 0.025 in, while the connected narrow panels 42, 43 have a thickness of about 0.085 in. This assures that the folding action of the accordion structure is substantially confined to flexing along the fold lines 44, 45 of the ridges and valleys. Building code and other requirements dictate that the space available at the front for accommodating the vertical portion of the flashing should not exceed 0.25 in. Accordingly, with the accordion sections in a relaxed configuration, neither extended nor compressed from the as-manufactured configuration, the wave height of the front folds, with the panels 42, 43 disposed at an approximately 90° angle, advantageously can be approximately 0.17 in. This allows the bellows sections to be significantly compressed while easily being contained within the desired 0.25 in space.

Figure 6:
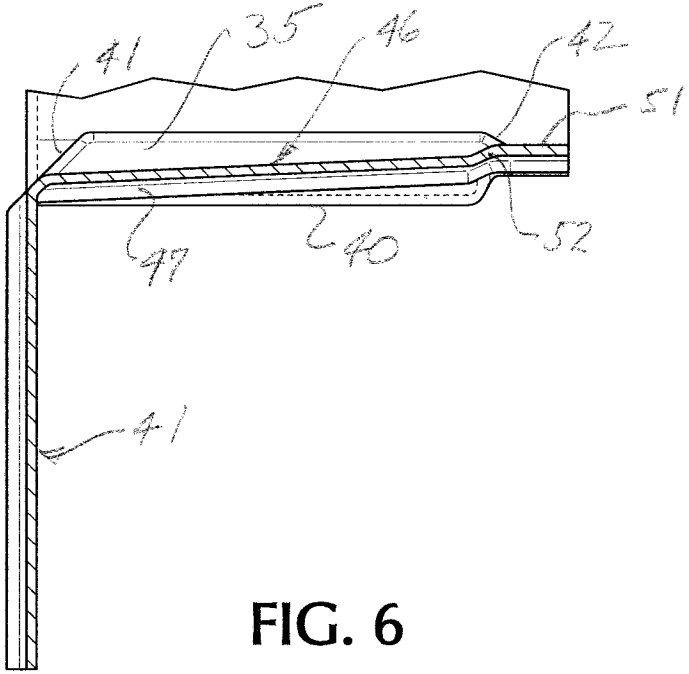
FIGS. 5 and 6 are cross sectional views as taken generally on lines 5-5 and 6-6 respectively of FIG. 2, with FIG. 5 illustrating positioning of the flashing with respect to members of a rough-framed window opening.

As reflected in the drawings, and particularly FIG. 6, the upper, portions 46 of the accordion sections 30, 31 are inclined slightly downward from back to front, desirably at an angle of approximately 2.5°, consistent with other upwardly facing surfaces of the flashing. As in the case of the vertical front portions 41, the inclined portions 46 are comprised of foldably connected narrow panels 47, 48 extending from front to back and connected along upwardly and downwardly projected (i.e., ridge and valley) fold lines 49, 50 respectively. The cross sectional configuration of the upper accordion portions 46 corresponds closely to that of the vertical front portions 41, with the fold lines 49, 50 having a thickness of about 0.025 in compared to a thickness of about 0.085 in for the panels 47, 48. Significantly, the fold lines 44 of the vertical portions 41, forming the ridges of the front folds, are aligned with the fold lines 50 of the inclined upper portions 46, forming the valleys of the upper portions. Likewise, the ridge fold lines 49 of the inclined portions 46 are aligned with the valley fold lines 45 of the vertical portions 41. With the thermoforming manufacturing process, this results in the junction between the upper and lower portions 46, 41 being disposed at an angle, as best indicated in FIG. 6.

Preferably, the positioning of the accordion sections 30, 31 is such that the valley fold lines 45, 50 of the vertical and inclined portions 41, 46 are substantially in a common plane with the adjacent flat panels of the sill plate cover 23. As a result, the foldably connected panels 47, 48 of the inclined portion of the accordion always project upwardly from the plane of the adjacent inclined panels, and the foldably connected panels 42, 43 of the vertical portion of the accordion always project forwardly from the plane of the adjacent vertical panels. This allows the accordion sections to be compressed as may be necessary during installation without displacing the adjacent panels of the flashing, which remain properly supported by the sill plate member of the rough framing. The presence of the accordion folds guarantees that a small space will exist between the installed window unit and the underlying flashing for the drainage of water. With conventional flashings, the window unit sometimes can be mounted so tightly to the framing as to impede free outward flow of water and cause damage over time.

In the illustrated embodiment of the invention the inclined upper portions 46 of the accordion sections 30, 31 are configured at the back with elevated portions 51, best shown in FIG. 1 and FIG. 6, which are connected to the main (inclined) portions of the accordion sections by transition portions 52. The elevated back portions 51 function in combination with the elevated ridges 37-39 to provide a continuous dam or barrier to the back flow of water under the effects of high winds. The transition portions 52 are disposed at a slight upward angle, while the elevated portions 51 preferably are horizontally disposed, preferably at a slightly lower elevation than the elevated ridges 37-39, it being understood that the actual height of the elevated portions 51 will vary with the extended or contracted condition of the flashing after it has been installed in the framed opening. Inasmuch as the angles between the inclined front portions, the elevated portions 51, and the transition portions 52 of the upper accordion portion 46 are relatively small, the ridges and valleys of the accordion fold can remain aligned. The ridge fold lines at the front remain aligned with the ridge fold lines at the back, and also the valley fold lines remain similarly aligned. This is evident in FIGS. 1 and 7.

In the exemplary embodiment of the invention, in which the sill plate cover 23 has an as-manufactured width of about 36 inches, the front to back depth of the flashing may be about 4.7 inches, and the vertical depth of the front structure may be about 4 inches. In the 36 inch example, the two accordion sections 30, 31 each may have a length of about 10 inches. During installation of the flashing in the rough framing of a window, each of the 10 inch accordion sections can easily be expanded or contracted by up to about 3 inches from their nominal 10 inch length. Accordingly, a nominal 36 inch flashing according to the invention can be expanded to about 42 inches or contracted to about 30 inches, enabling a single nominal size of flashing to be installed in a wide variety of nominal sizes of rough openings.

For installation of a flashing in a rough frame opening having a width greater than the nominal width of the flashing, one end portion 21, 22 of the flashing is first secured to an upright frame member at one side. The flashing is then extended laterally until the second end portion is engaged with the opposite side upright frame member, and the second end portion is then secured thereto. When the nominal width of the flashing is greater than the width of the rough framed opening, it is merely necessary to first compress the flashing to fit between the framing uprights and then secure each of the end portions to the upright framing members. Preferably, the flashing is secured to the framed opening by fastening the flange walls 22, 27 and/or 24, 25 to the vertical members 18 of the framed opening. Whether the flashing must be lengthened or shortened during installation, the entire installation process is highly efficient and expeditious; and since the flashing has no cuts or overlaps the weatherproof integrity of the flashing is maximized.

The flashing of the invention is of enormous practical benefit in that, in addition to enabling the flashing to be manufactured and installed in one piece, it further enables the manufacturers and sellers to make and inventory a much smaller number of flashing sizes than the number of window sizes that can be serviced thereby. Moreover, a smaller variety of flashing sizes is required for workmen to deal with at the job site during installation, with corresponding savings in both time and money.

An extra advantage of the present invention resides in the fact that the ability of the accordion sections to be compressed or extended during installation also allows them to be expanded at one edge while remaining the same or being compressed at the opposite edge. For example, a vertical portion of an accordion section may be expanded fan-like in lower portions while being compressed in upper portions. The accordion sections thus have the ability to be disposed in an arcuate configuration which can be useful in connection with the flashing of curved window configurations.

It should be understood that the various directional references herein, such as upward, downward, laterally, vertical, horizontal, etc. are intended to relate to the invention in the particular form and orientation illustrated herein and are not to be considered in any way as limiting the invention to any particular form or orientation. It should also be understood that the specific forms of the invention herein illustrated and described are intended to be representative of a preferred embodiment of the invention and not in limitation thereof. Accordingly, reference should be made to the following claims in determining the full scope of the invention.

What is claimed is:

1. A one piece, laterally adjustable sill pan flashing installable in one piece in a framed opening, where the framed opening includes opposite side frame members and a sill plate member extending between the side frame members, which comprises, a sill plate cover including a downwardly and forwardly inclined upper portion configured to extend over the sill plate member, and a generally vertical portion configured to extend downwardly from a front of said inclined upper portion, said sill plate cover including at least one width-adjustable accordion section, said accordion section being extendable or contractible in width during installation to enable respective end portions of said sill plate cover to be seated against opposite side members of a framed opening, said inclined upper portion of said sill plate cover including support elements adjacent opposite ends thereof defining a support plane elevated with respect to said accordion section and configured to support a window or door unit above said accordion section, said sill plate cover being configured such that at least rear portions of said sill plate cover, including said accordion section, are supported in elevated relation to said sill plate member, said accordion section comprising a forwardly and downwardly inclined upper portion formed of a plurality of foldably connected narrow panels extending in a front to back direction and joined along lateral edges thereof to form a succession of ridges and valleys, and a lower portion which is generally vertical and is formed of a plurality of foldably connected narrow panels extending vertically and joined along lateral edges thereof to form a succession of ridges and valleys.

2. A one piece, laterally adjustable sill pan flashing according to claim 1, wherein, said flashing is formed of a single piece of thermoformed or injection molded plastic material.

3. A one-piece sill pan flashing according to claim 1, wherein said foldably connected narrow panels have a thickness cross section greater than a thickness of material at said ridges and valleys such that folding action of said accordion is substantially confined to flexing along fold lines at said ridges and valleys.

4. A one piece, laterally adjustable sill pan flashing installable in one piece in a framed opening, where the framed opening includes opposite side frame members and a sill plate member extending between the side frame members, which comprises, a sill plate cover including a downwardly and forwardly inclined upper portion configured to extend over the sill plate member, and a generally vertical portion configured to extend downwardly from a front of said inclined upper portion, said sill plate cover including at least one width-adjustable accordion section, said accordion section being extendable or contractible in width during installation to enable respective end portions of said sill plate cover to be seated against opposite side members of a framed opening, said inclined upper portion of said sill plate cover including support elements adjacent opposite ends thereof defining a support plane elevated with respect to said accordion section and configured to support a window or door unit above said accordion section, said accordion section comprising a forwardly and downwardly inclined upper portion formed of a plurality of foldably connected narrow panels extending in a front to back direction and joined along lateral edges thereof to form a succession of ridges and valleys, and a lower portion which is generally vertical and is formed of a plurality of foldably connected narrow panels extending vertically and joined along lateral edges thereof to form a succession of ridges and valleys, the ridges of said lower accordion portion being aligned with the valleys of said upper accordion portion, and the valleys of the lower accordion portion being aligned with the ridges of the upper accordion portion, said accordion section being formed of a single piece of thermoformed plastic material, and said foldably connected narrow panels having a thickness cross section greater than a thickness of material at said ridges and valleys such that folding action of said accordion is substantially confined to flexing along fold lines at said ridges and valleys.

5. A one-piece, laterally adjustable sill pan flashing according to claim 4, wherein, the entire flashing is thermoformed of a single piece of plastic material.

6. A one-piece, laterally adjustable sill pan flashing according to claim 4, wherein, elements of said sill plate cover exclusive of but connected to said at least one accordion section define a forwardly and downwardly inclined plane and a vertical plane, the foldably connected panels forming the inclined upper portion of said accordion section are configured with their inclined valley fold lines substantially in said inclined plane whereby the folds of said upper portion project upward from said inclined plane, and the foldably connected panels forming the vertical portion of said accordion section are configured with their vertical valley fold lines substantially in said vertical plane whereby the folds of said vertical portion project outwardly from said vertical plane.

7. A one-piece, laterally adjustable sill pan flashing according to claim 4, wherein, the inclined upper portion of said sill plate cover, in the regions thereof exclusive of said at least one accordion section, is formed adjacent to a back edge thereof with a laterally extending elevated ridge.

8. A one-piece, laterally adjustable sill pan flashing according to claim 7, wherein, a front portion of said at least one accordion section extends rearwardly from a front edge thereof at a low-angle upward incline to a region spaced forward from a back edge thereof, a transition portion of said at least one accordion section extends from said front portion upward and rearward at an angle steeper than said low-angle incline, and an elevated portion of said at least one accordion section extends rearward from said transition portion.

9. A one-piece, laterally adjustable sill pan flashing according to claim 8, wherein, ridge and valley folds of said transition and elevated portions are aligned with the ridge and valley folds of the front portions from which they extend.

10. A one piece, laterally adjustable sill pan flashing installable in one piece in a framed opening, where the framed opening includes opposite side frame members and a sill plate member extending between the side frame members, which comprises, a sill plate cover including a downwardly and forwardly inclined upper portion configured to extend over the sill plate member, and a generally vertical portion configured to extend downwardly from a front of said inclined upper portion, said sill plate cover including at least one width-adjustable accordion section, said accordion section being extendable or contractible in width during installation to enable respective end portions of said sill plate cover to be seated against opposite side members of a framed opening, said inclined upper portion of said sill plate cover including support elements adjacent opposite ends thereof defining a support plane elevated with respect to said accordion section and configured to support a window or door unit above said accordion section, said sill plate cover being thermoformed of plastic material, said elements defining said support plane being in the form of upwardly projecting ribs extending in a front to back direction on opposite lateral sides of said accordion section, and said ribs being shaped in the form of downwardly opening waves having horizontally disposed upper surfaces forming said support portions.

11. A one-piece, laterally adjustable sill pan flashing according to claim 10, wherein, said ribs have, at each side of said downwardly opening waves, a horizontally disposed support element forming a horizontally disposed bottom support surface extending in a front-to-back direction and engageable with a sill frame member to support the upper portions of said sill plate cover on a forwardly and downwardly inclined plane.

12. A one-piece sill pan flashing installable in one piece, which comprises, a sill cover configured to overlie a sill plate member of a rough-framed window or door opening, said sill cover being disposed at a forwardly and downwardly inclined angle, a front cover joined at an upper edge thereof with a forward edge of said sill cover, said sill cover extending vertically downward from said forward edge and configured to overlie a front of the sill plate member, said sill cover and said front cover each including a laterally extendable and contractible accordion section comprised of a series of narrow panels foldably connected along fold lines forming ridge folds and valley folds, said sill cover being configured such that at least rear portions thereof, including said accordion section, are supported in elevated relation to said sill plate member, the respective accordion sections of said sill cover and said front cover being so aligned that valley folds of the sill cover accordion section are aligned with ridge folds of the front cover accordion section and the ridge folds of the sill cover accordion section are aligned with the valley folds of the front cover accordion section.

13. A one-piece sill pan flashing according to claim 12, wherein said flashing is formed of a single piece of thermoformed plastic material.

14. A one-piece sill pan flashing according to claim 12, wherein said flashing is formed of a single piece of injection molded plastic material.

15. A one-piece sill pan flashing according to claim 12, wherein sections of said sill cover, exclusive of said accordion section, are formed with upwardly projecting and laterally extending elevated ridges along the back thereof, and a first portion of the sill cover accordion section extends rearward for a first distance at a first upwardly inclined angle, a second portion of the sill cover accordion section extends rearward for a second distance from said first portion at a greater angle of incline than said first portion, and a third portion if the sill cover accordion section extends horizontally rearward for a third distance from said second portion, said second and third portions of said sill cover accordion section forming an elevated ridge aligned with said upwardly projecting elevated ridges.

16. A one-piece sill pan flashing according to claim 12, wherein said foldably connected narrow panels have a thickness greater than a thickness of material at said ridges and valleys such that folding action of said accordion sections is substantially confined to flexing along fold lines at said ridges and valleys.

17. A one-piece sill pan flashing according to claim 12, wherein said sill cover and said front cover include panels connected to laterally outer edges of said accordion sections, the valley fold lines of said accordion sections are disposed substantially in planes defined by said panels, whereby the folds of the accordion section of said sill cover project upwardly relative to the panels of said sill cover and folds of the accordion section of the front cover project forwardly with respect to the panels of said front cover.

* * * * *